US005518171A

United States Patent [19]

Moss

[11] Patent Number: 5,518,171

[45] Date of Patent: May 21, 1996

[54] PARTITION AND CONTAINER

[75] Inventor: H. D. Moss, Arlington, Tex.

[73] Assignee: Coroplast, Inc., Dallas, Tex.

[21] Appl. No.: 431,146

[22] Filed: Apr. 28, 1995

[51] Int. Cl.[6] ..... B65D 5/499

[52] U.S. Cl. ..... 229/120.36; 229/120.38; 493/91; 493/391; 493/912

[58] Field of Search ..... 229/120.36, 120.38; 217/30–33; 493/91, 391, 912

[56] References Cited

U.S. PATENT DOCUMENTS

| | | | |
|---|---|---|---|
| 324,999 | 8/1885 | Jaeger | 217/32 |
| 529,173 | 11/1894 | Herr | 217/32 |
| 786,827 | 4/1905 | Meyer | 217/32 |
| 882,049 | 3/1908 | Carter | 217/32 |
| 1,675,279 | 6/1928 | Segur et al. | 493/91 |
| 2,466,275 | 4/1949 | Ringel | 217/32 |
| 4,194,675 | 3/1980 | Peters, Jr. | 217/32 |
| 4,544,092 | 10/1985 | Palmer | 229/120.36 |
| 4,591,090 | 5/1986 | Collins et al. | 217/32 |
| 4,685,609 | 8/1987 | Ferrari | 229/120.36 |
| 4,795,083 | 1/1989 | Johnske | 217/32 |

*Primary Examiner*—Gary E. Elkins
*Attorney, Agent, or Firm*—Crutsinger & Booth

[57] ABSTRACT

A partition lock for a reticular or grid cell assembly having a first and a second planar member. The partition lock comprises a first slot; a second slot; a tab portion; and a receiving aperture. The first slot is defined at a substantially vertical position in the first planar member. The second slot is defined at a substantially vertical position in the second planar member. Each slot has a first and a second side and a width sufficient to accept the member to be inserted in the slot. The second slot sufficiently cooperates with the first slot to allow the first and the second planar member to align within substantially the same plane when the two pieces are interjoined. The tab portion is positioned on the first member extending from the first side of the first slot to a first notch in the second side of the first slot such that the first tab portion is received in a notch formed in the slot. The receiving aperture is formed in the second planar member along an axis of the second slot and adjacent a reinforcing ridge. The receiving aperture is adapted to receive the tab portion positioned on the first planar member as the tab portion engages the notch formed in the slot.

13 Claims, 5 Drawing Sheets

PARTITION AND CONTAINER

FIELD OF THE INVENTION

This invention relates to a partition locks for connecting internal partitions used in containers and the like.

BACKGROUND OF THE INVENTION

Shipment packaging has undergone constant changes and advances to better protect products, such as glassware, while being shipped. In some uses, partitions are used to separate the goods contained therein. When partitions are placed at angles to each other, they are typically slotted to interlock with each other. Nevertheless, the conventional opposing slot method of assembling partitions, the upper portions of the partitions are not reinforced or supported causing the partitions to degrade and become ineffective for their designated purpose after repeated use.

The problem presented by slotted partitions has been addressed partly by fastening the partitions together at the intersection by the use of flute wires or the like. In corrugated material applications, the partitions are cut with the flutes running horizontally. The flute wires are hand-threaded into open ends of the flutes. Although the flute wiring adds additional rigidity and durability to the partitions, the flute wire also incurs additional labor and material costs. The resulting assembly is typically more expensive and undesirable heavier shipping container. The additional weight of the flute wire also translates into increased transportation costs which are typically passed on to the consumer.

Furthermore, the addition of flute wiring in the partitions affects the recycling capability of the partitions. Normally, the partitions are simply recyclable without any preparation. But partitions utilizing flute wiring must first have the flute wiring removed before recycling can occur. This step incurs additional labor costs which adversely affects the economic feasibility of recycling.

Many assemblers will not accept packaging that cannot be returned to the parts distributors because of the disposal costs associated with the packaging materials. These costs are generally associated with dumping costs or the costs for incineration of the waste. Therefore, the user of such packaging must have collapsible packaging for a return trip to the product distributor or supplier. Also, reusable packaging has substantial advantages.

Therefore, a need exists for reinforcing partitions used in shipping that does not add weight to the partitions nor increases the complexity of the partitions while still allowing the partitions to be collapsed for return to the distributor.

SUMMARY OF THE INVENTION

In accordance with the present invention a partition lock is implemented for a reticular or grid array cell assembly having at least a first and a second intersecting planar partition members. The partition lock comprises a first slot, a second slot, a tab portion and a receiving aperture. The first slot extends in a substantially transverse direction in the first planar member. The first slot has a first and a second edge and a width therebetween sufficient to accept the second planar member. The second planar member has a corresponding second slot. The first and the second slots cooperate to allow the first and the second planar member to align within substantially the same plane. A tab portion is formed in the first planar member. The tab portion extends from the first edge of the first slot to a first notch formed in the second side of the first slot. The first notch receives the first tab portion to reinforce and stabilize the tab in the occurrence of a longitudinal force acting on the tab, thereby preventing the partitions from dislodging. A corresponding tab and notch are formed in the second member. The receiving aperture is formed in the second member along a longitudinal axis of said second slot. The receiving aperture is adapted to receive the tab portion on the first planar member as the tab portion engages the notch positioned in the first slot. In a similar manner the first member has a receiving aperture for the tab of the second member.

When the first and the second members are slid together or assembled the members are locked together. The members are assembled by placing the first member with a slot and a tab into a second member having a substantially corresponding slot with a second tab. Both tabs extend across the slots into a notch formed in the side of the slot. A torsional force or twisting force is imposed against each slot by twisting the first member and the second member, causing the first tab and the second tab to disengage from their respective notches. A longitudinal force is imposed such that the first and the second members are urged into an engaged position. The two members are then urged apart in a torsional fashion to urge the tabs into their respective notches, thereby locking the intersection of the partitions which is formed by the first and the second member. The locked partition can be placed in a case or box to form a reticulated assembly comprising a plurality of cells.

BRIEF DESCRIPTION OF THE DRAWING

The accompanying drawing is incorporated into and forms a part of the specification to illustrate several examples of the present invention. The figures of the drawing together with the description serve to explain the principles of the invention. The drawing is only for the purpose of illustrating examples of how the invention can be made and used and is not to be construed as limiting the invention to only the illustrated and described examples. The various advantages and features of the present invention will be apparent from a consideration of the drawing in which.

DESCRIPTION OF PREFERRED EMBODIMENT

Figure 1A:
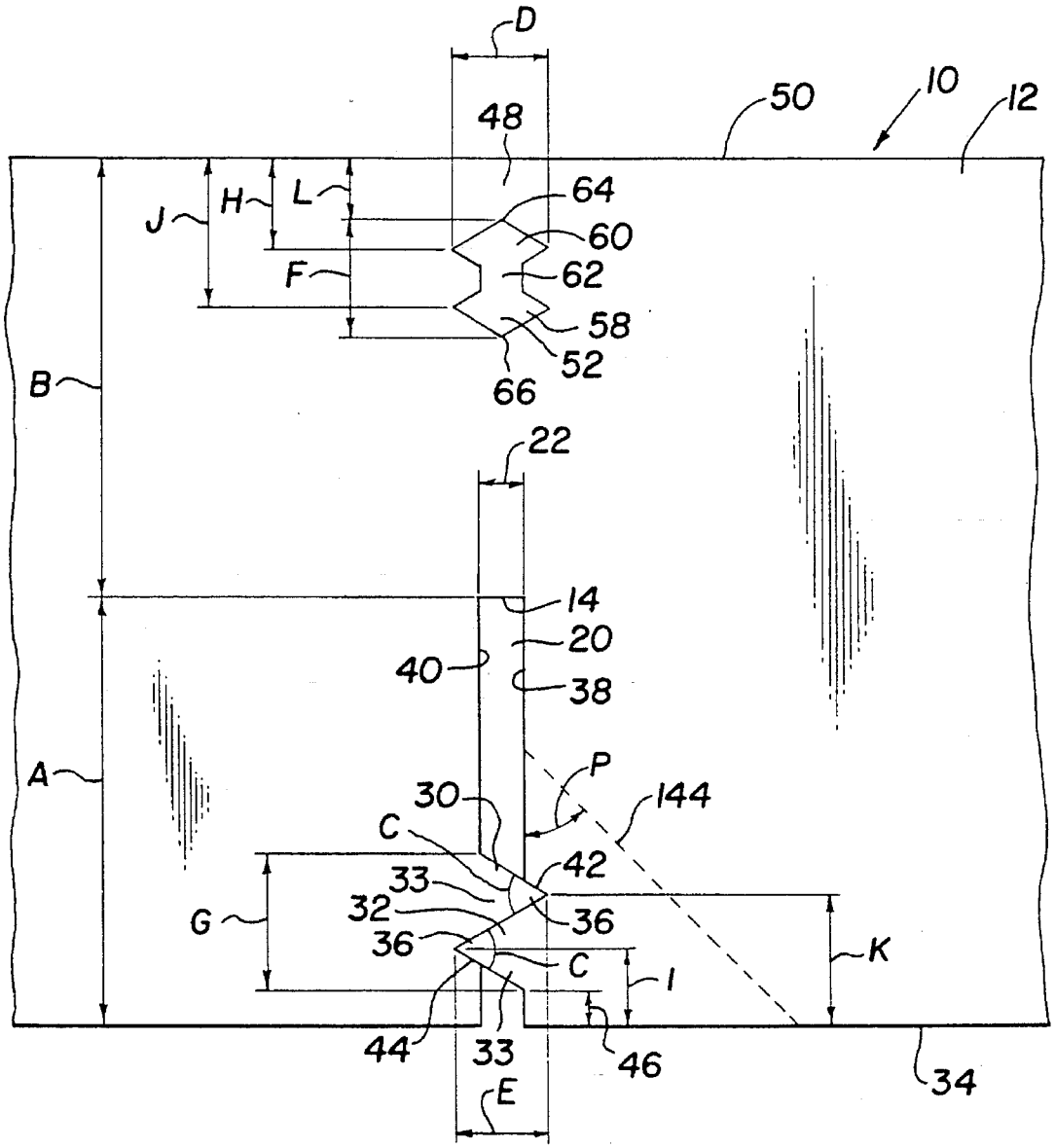
FIG. 1(*a*)–(*b*) respectively, are plan views of one example of a first partition and a second partition in accordance with the teaching of the present invention.

The present invention will be described by referring to examples of how the invention can be made and used. Like reference characters are used throughout the several views of the drawing to indicate like or corresponding parts. The structure comprising the partition lock of the present invention has applications when two or more partitions are used. The invention utilizes an inventive concept to lock the partitions together at the intersection of the partitions.

Figure 1B:
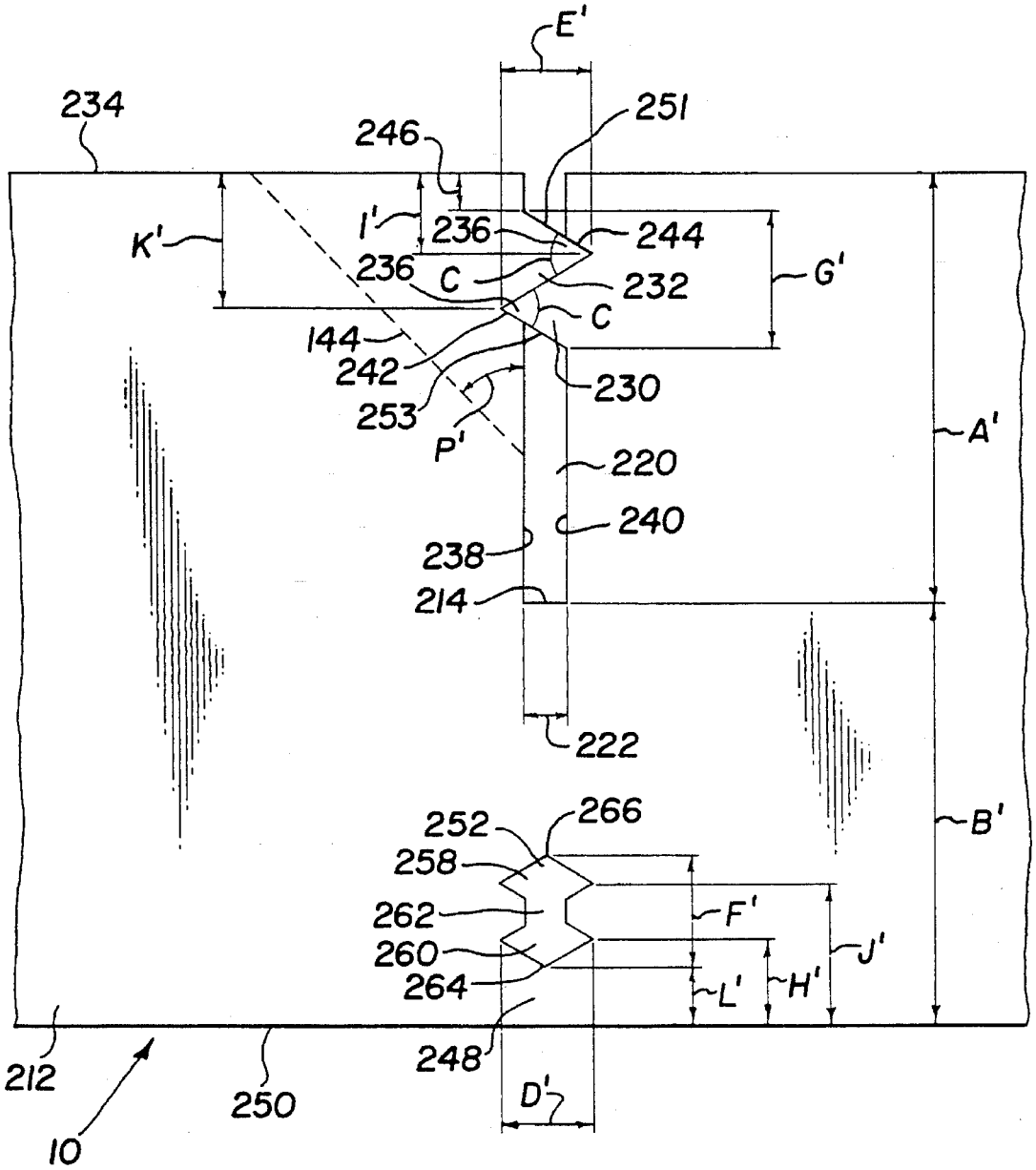
Figure 2:
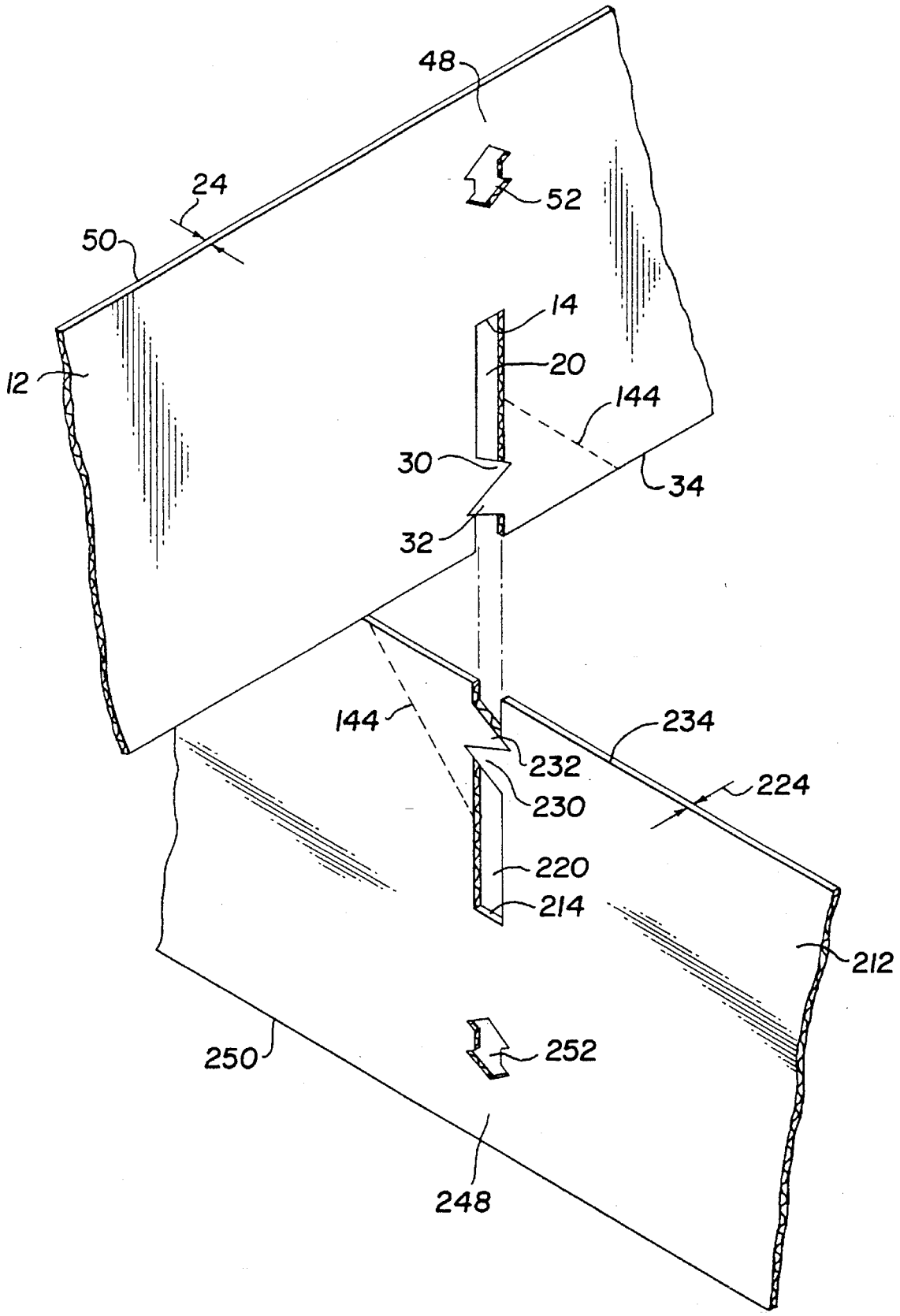
FIG. 2 is a perspective view of the first and the second partition depicted in a pre-assembly posture.

A partition lock is generally designated by the number 10 is shown in FIG. 1(*a*)– (*b*). A first partition sheet 12 is shown in FIG. 1(*a*) and a second partition sheet 212 is shown in FIG. 2(*b*). The partition sheets are made of a flexible, resilient material such as cardboard or plastic. Preferably, the partition sheets 12 and 212 are made of a sheet material. The partition lock 10 as disclosed is a relational locking mechanism that can be manufactured using techniques known in the art.

Figure 3:
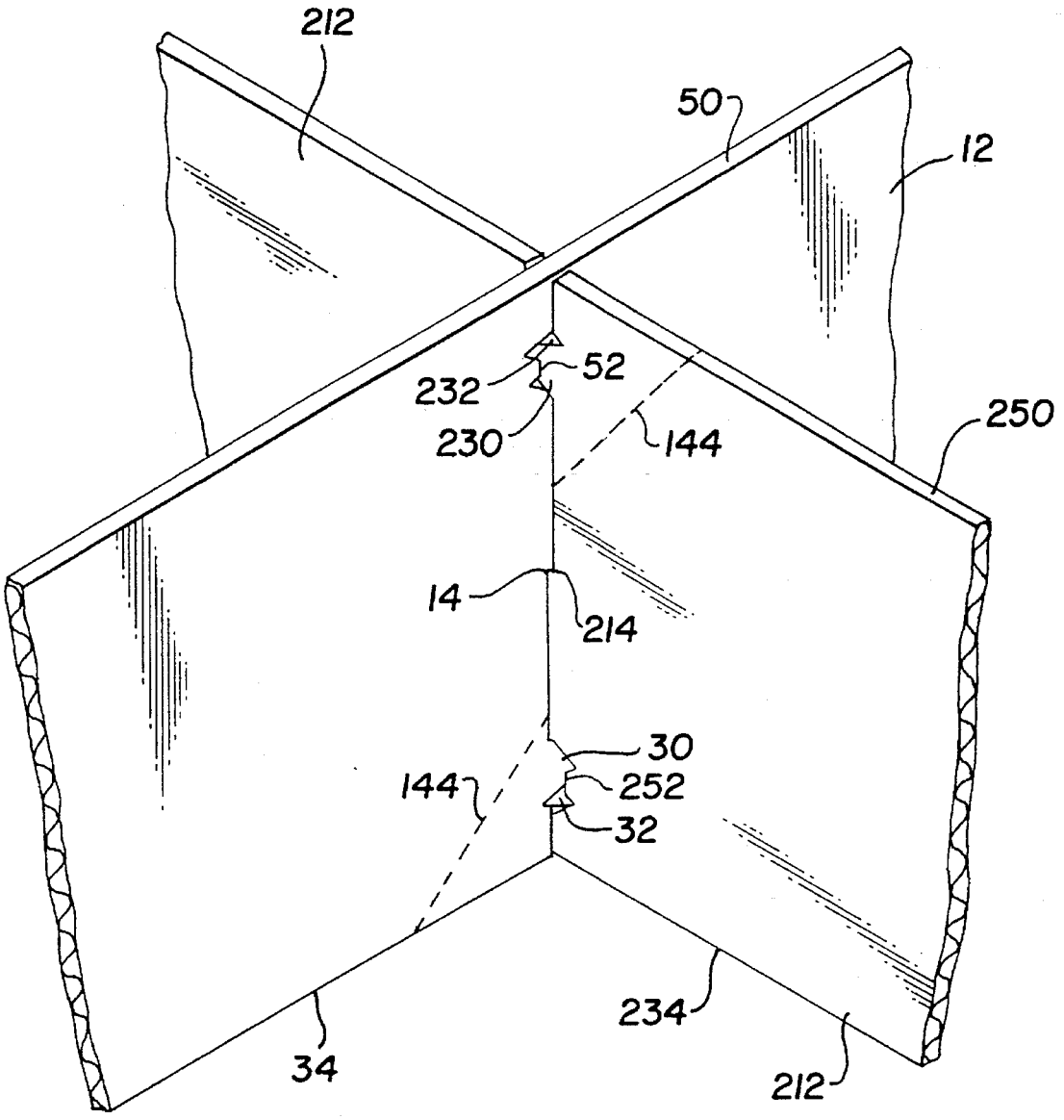
FIG. 3 is a perspective view of the partitions locked in place.

Referring to FIGS. 1(*a*)–(*b*), shown is a first slot 20 defined at a substantially vertical position in the first partition sheet 12. The width 22 of the first slot 20 corresponds to a thickness 224 of the second partition sheet 212 (as best shown in FIG. 3) so that the second partition will fit into the slot 20. It is preferred that the slot width be minimized for rigidity, yet be wide enough to allow efficient assembly. The length A of the first slot 20 corresponds to a length B' of the second partition 212 measured from the end surface 214 of the substantially vertical second slot 220 to a first edge 250.

A first tab 30 and a second tab 32 are located adjacent a second edge 34 of the first partition 12. As shown in FIG. 1(*a*), the first and the second tabs 30 and 32 have generally triangular body portions 31 and 33, respectively, opposingly oriented. The apexes 36 on the body portions 31 and 33 are formed at an angle between about 25 degrees to about 40 degrees as represented by the angle C. Preferably the angle C is about 60 degrees. The tip or apex 36 of the first tab and the second tab 30 and 32 are embedded in opposite first slot walls 38 and 40, respectively, in notches 42 and 44, respectively. Notches 42 and 44 are adapted to receive the first and the second tabs 30 and 32 at the tab apexes 36 to retain the tabs 30 and 32 in position upon the occurrence of a longitudinal force acting against the first and the second tabs. As shown in FIGS. 1(*a*)–(*b*), the first and the second tabs 30 and 32 are distal from the second edge 34 by an offset 46. The offset 46 is sufficient to accept the reinforcement ridge portion 248 of the second partition 212.

Adjacent the first edge 50 of the first partition 12 and aligned with slot 20 is a tab receiving aperture 52 which adaptively accepts the first and second tabs 230 and 232, respectively, of the second partition 212. As shown, it is preferred that the receiving aperture 52 comprises two substantially diamond shaped aperture portions 58 and 60 communicating with each other through a channel aperture portion 62. Aperture 52 is spaced from edge 50 to panel 12 so that uncut materials comprising the reinforcing ridge 48 is therebetween.

As will be explained, the shape of the tabs correspond to the shape of the apertures to improve assembly and locking. The diamond apertures 58 and 60 have a width D that corresponds to a tab width E' designated by the tabs 230 and 232 of the second partition 212. As should be noted, the first and second tabs 230 and 232, respectively, of the second partition are shown with identical penetration depths beyond the edges 238 and 240 of the slot 220. However, these penetration depths can be different for each individual tab 30, 32, 230 and 232. Such a difference can be reflected in the widths of the individual diamond aperture portions 58 and 60 of the first partition 12. The channel aperture portion 62 has a width sufficient to accept the thickness 224 of the second partition 212. The distance F measured from the first point 64 to a second point 66 of the tab receiving aperture 52 is sufficient to accept the tab insertion length dimension G' designated by a base point of the inclined surface 253 of the first tab 230 and a base point along the inclined surface 251 of tab 232. The inclined surfaces of the tabs permit ready insertion of the tabs into the apertures 52 and 252, respectively. The ramping effect of the inclines further allows a greater engagement area between the tabs and the notches 42 and 44 such that the inclined surfaces frictionally engage the inner surfaces of the notches 42 and 44 when a longitudinal force acts on the partition lock 10.

The second diamond aperture portion 60 is spaced a distance H from the first edge 50 of the first partition 12. The distance H corresponds with the distance I' as measured from the first edge 234 of the second partition 212. Similarly, the first diamond aperture portion 58 is placed a distance J from the first edge 50 of the first partition 12. The distance J corresponds with the distance K' measured from the first edge 234 of the second partition 212.

Referring to FIG. 1(*b*), shown is the second partition member 212 which corresponds to the first partition member 12 shown in FIG. 1(*a*). It is preferred that the first and the second partitions 12 and 212 be mirror images containing equivalent elements. For convenience, the correlating elements are numbered beginning in the 200s. Nevertheless, slight variations in the relational dimensions between the first and the second partition members 12 and 212 may be accomplished with similar results.

A fold line is formed by a score 144 placed across the first and the second partitions 212 and 212 to aid in flexing the material of the partitions 12 and 212 when a torsional force is applied for assembly of the partition lock. The score line 144 is sufficient to allow the partition material to bend more readily yet still retain the desired rigidity and durability of the material. The score 144 can be formed by the use of a perforated score implementing by a series of minute holes along a line. As shown in FIGS. 1(*a*)–(*b*), the scores 144 are placed at an angles P and P', respectively, having a value from about 30 degrees to about 55 degrees. Preferably the value of the angle P and P' is about 45 degrees. The scores 144 intersect the edges of the slots 20 and 220 at a point sufficient to allow the scored portions of the partitions 12 and 212 to yield to a torsional force but not beyond the end surfaces 14 and 214 of slots 20 and 220, respectively.

As shown in FIG. 2, the first and the second partition 12 and 14 are inserted such that the partition lock can engage. The slots 20 and 220 are aligned and inserted into one another until the second tabs 32 and 232 are encountered. A torsional force is applied against each partition 12 and 212 such that the slots 20 and 220 become disjointed, causing the tabs 30, 32, 230 and 232 to disengage the notches 42, 44, 242 and 244, respectively. Insertion of the first partition 12 can thus continue until the end surface 14 of the slot 20 encounters the end surface 214 of the slot 220. The first and the second partition 12 and 212 lie adjacent to one another and the tabs 30, 32, 230 and 232 are not inserted in the receiving apertures 52 and 252. The first and the second partitions 12 and 212 are torsionally urged apart to cause the tabs 30, 32, 230 and 232 to pivot through the receiving apertures 52 and 252 into engaging contact with the corresponding notches 42, 44, 242 and 244, respectively, as best shown in FIG. 3.

Figure 4:
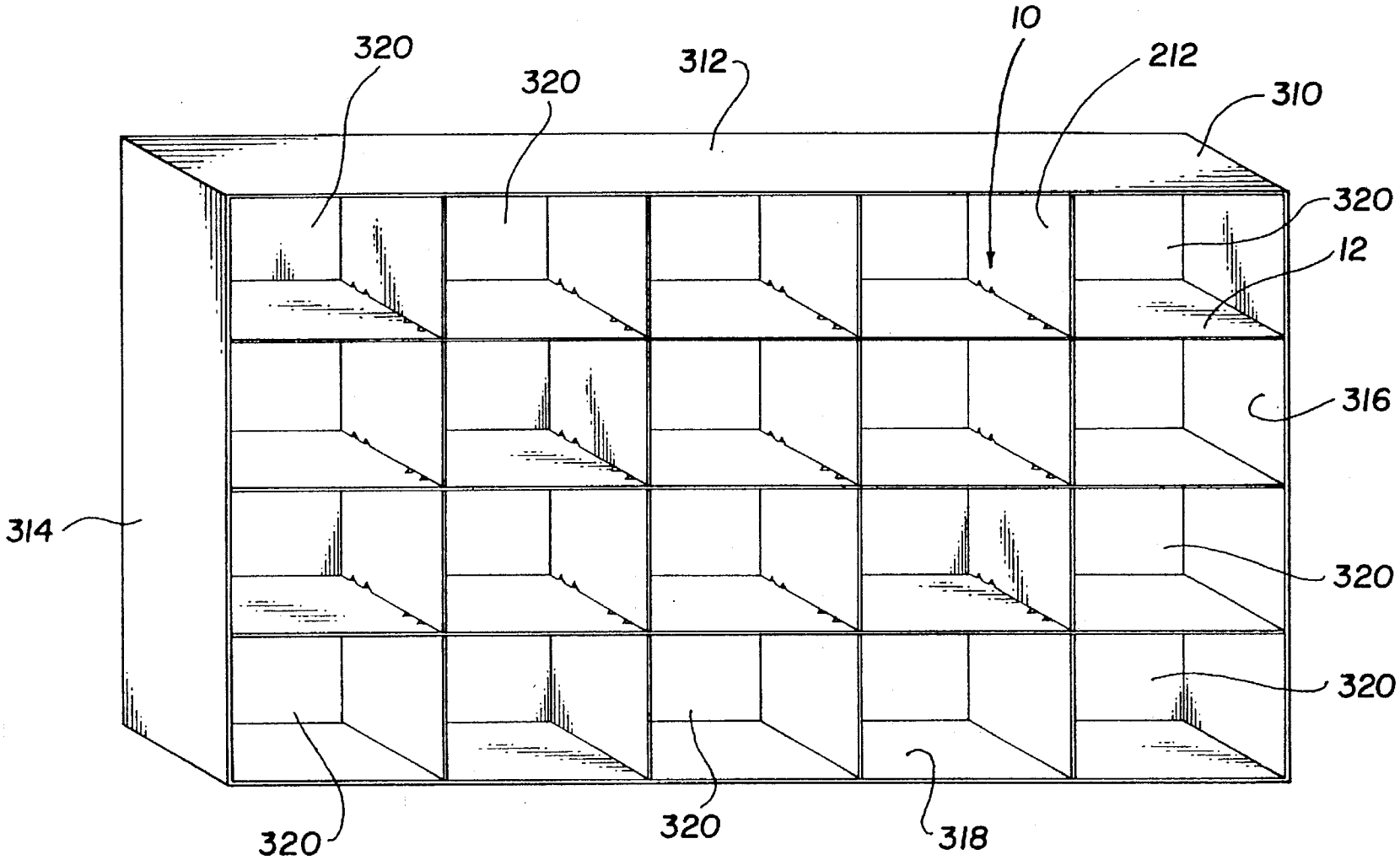
FIG. 4 is a perspective view of the partition lock implemented in a shipping package.

Referring to FIG. 4, shown is a case 310 implementing the partition look 10 to form a reticulated or gridded cell assembly. The case 310 has a top face 312, a first side face 314, a bottom face 318 and a second side face 316. The first partition 12 and the second partition 212 can have a plurality of partition locks 10. As illustrated, the first and the second partitions 12 and 212, respectively, can be joined to form perpendicular angles within the case 310 to form rectangular cells 320. The number of cells 320 may be varied with the number of partitions used. For example, simply using the first and the second partition 12 and 212 as shown in FIG. 3, a four cell reticular assembly can be created. Furthermore, the dimension of the cells 320 can generally vary with respect to one another according to the size and variety of the product being shipped.

Furthermore, the first and the second partitions can form varying degrees of angles with equal effectiveness. The partitions can be joined at an intersection with about 40 degrees to about 140 degrees angle of intersection forming diamond shaped cells. Additionally, the partitions can be oriented in a diagonal direction relative to the case 310. The partition lock can be utilized in any form of reticular cell assembly and will hold up to the wear and repeated use, but can still be readily recycled and no added weight results in transportation costs.

The description and figures of the specific examples above do not point out what an infringement of this invention would be, but are to provide at least one explanation of how to make and use the invention. Numerous modifications and variations of the preferred embodiments can be made without departing from the scope and spirit of the invention. Thus, the limits of the invention and the bounds of the patent protection are measured by and defined in the following claims.

What is claimed is:

1. A partition lock for a reticular assembly having at least a first and a second planar member, said partition lock comprising:

(a) a first slot extending in a substantially transverse direction in the first planar member, said first slot having a first and a second side and a with sufficient to accept the second planar member into said first slot;

(b) a second slot extending in a substantially transverse direction in the second planar member, said second slot having a first and a second side and a width sufficient to accept the first planar member, said second slot sufficiently cooperating with said first slot to allow the first and the second planar member to intersect each other;

(c) a first tab portion positioned on the first planar member extending from said one side of said first slot to a first notch formed in the second side of said first slot such that said first tab portion is received in the first notch;

(d) a second tab portion positioned on the first planar member adjacent and oppositely oriented to said first tab portion, said second tab portion extending from the second side of said first slot to a second notch in the first side of said first slot; and e) a receiving aperture formed in the second planar member spaced from and substantially aligned with said second slot, a reinforcing ridge is formed adjacent to said aperture, said receiving aperture is adapted to receive said first and said second tab portions therein to lock said planar members together.

2. A partition lock as set forth in claim 1 further comprising:

(f) a third tab portion positioned on the second planar member extending from the first side of said second slot to a first notch in the second side of said second slot; and (g) a second receiving aperture formed in the first planar member along a longitudinal axis of said first slot adapted to pivotally receive said third tab portion positioned on the second planar member as said second tab portion engages the second notch positioned said second slot.

3. A partition lock as set forth in claim 2 further comprising:

(h) a fourth tab portion positioned on the second planar member adjacent said third tab portion, said fourth tab portion extending from the second side of said second slot to a second notch in the first side of said second slot.

4. A partition lock as set forth in claim 1 wherein each said tab portion is a tapered tab portion.

5. A partition lock as set forth in claim 1 wherein each said tab portion has a triangular body.

6. A partition lock as set forth in claim 5 wherein said triangular body is shaped as an isosceles triangle having a 30 degree angle.

7. A partition lock as set forth in claim 3 wherein each said tab portion has a triangular body.

8. A partition lock as set forth in claim 7 wherein each said triangular body is shaped as an isosceles triangle having a 60 degree angle.

9. A partition lock as set forth in claim 5 wherein said receiving aperture comprises:

a first substantially diamond-shaped aperture adapted for receiving said first tab portion as it extends to engage said first notch in said second side of said first slot;

a second substantially diamond-shaped aperture adapted for receiving said second tab portion as it extends to engage said second notch in said first side of said first slot; and a channel aperture portion extending from said first substantially diamond-shaped aperture to said second diamond-shaped aperture such that said first diamond shape aperture and said second diamond shape aperture can communicate with each other.

10. A partition lock as set forth in claim 1 further comprising a score oriented at an angle adjacent said first tab portion for facilitating the assembly of the first and the second planar members.

11. A partition lock as set forth in claim 10 wherein said score is a perforated score positioned at about 45 degrees.

12. A combination comprising:

(a) a first planar member having a top edge surface, a bottom edge surface and a substantially vertical first slot with a first side and a second side and a width;

(b) a second planer member having a substantially vertical second slot with a first and a second side and a width sufficient to accept said first planar member, said second slot sufficiently cooperating with the first slot to allow said first and said second planar member to align within substantially the same plane wherein the width of the first slot is sufficient to accept said second planar member;

(c) a tab portion positioned on said first planar member extending from the first side of said first slot to a first notch in the second side of said first slot such that said first tab portion is received in the first notch positioned in the first slot;

(d) a receiving aperture formed in said second planar member along an axis of said second slot adapted to pivotally receive said tab portion positioned on said first planar member as said tab portion engages the first notch positioned in the first slot; and (e) a score extending from the first side of the first slot to the top edge surface said first planar member and adjacent the first slot, said score being oriented at an angle with a reference point designated by the first side to facilitate the assembly of said first and said second planar members.

13. A method of forming a reticulated cell array having a partition lock comprising the steps of:

placing a first planar member having a substantially vertical first slot with a first tab extending from a first side of said slot to a first notch on a second side of the first slot into a second planar member having a corresponding substantially vertical second slot with a second tab extending from a first side of the second slot to a second notch on a second side of the second slot;

imposing a torsional force against the first and the second planar member through each slot of each of the members by twisting the first planar member and the second planar member to resiliently disengage the first tab from the first notch and the second tab from the second notch;

imposing a longitudinal force such that the first and the second planar members are urged into an engaged position; and correspondingly locking the first planar and the second planar member at an intersection of the partitions into a consolidated reticulated assembly by urging the first tab through a first aperture in the second planar member adapted to pivotally accept the first tab and by urging the second tab through a second aperture in the first planar member adapted to pivotally accept the second tab by urging the first and the second planar member into a distal relationship.

* * * * *